US012221979B2

(12) United States Patent
Park et al.

(10) Patent No.: US 12,221,979 B2
(45) Date of Patent: Feb. 11, 2025

(54) FAN SHROUD ASSEMBLY

(71) Applicant: Hanon Systems, Daejeon (KR)

(72) Inventors: Cheolun Park, Daejeon (KR); Jun Ho Kim, Daejeon (KR); Ok Ryul Min, Daejeon (KR); Sang Hyun Lee, Daejeon (KR); Jae O Jung, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/273,292

(22) PCT Filed: Feb. 4, 2022

(86) PCT No.: PCT/KR2022/001729
§ 371 (c)(1),
(2) Date: Jul. 20, 2023

(87) PCT Pub. No.: WO2022/169281
PCT Pub. Date: Aug. 11, 2022

(65) Prior Publication Data

US 2024/0141920 A1 May 2, 2024

(30) Foreign Application Priority Data

Feb. 5, 2021 (KR) ..... 10-2021-0016760

(51) Int. Cl.
*F04D 29/66* (2006.01)
*F04D 29/52* (2006.01)

(52) U.S. Cl.
CPC ..... *F04D 29/522* (2013.01); *F04D 29/663* (2013.01)

(58) Field of Classification Search
CPC ..... F04D 29/662; F01P 5/06
See application file for complete search history.

(56) References Cited

U.S. PATENT DOCUMENTS 6,863,496 B2 * 3/2005 Cho ..... F04D 29/685 415/222
2018/0202452 A1 7/2018 Springer et al.
2018/0376614 A1 12/2018 Xiong et al.

FOREIGN PATENT DOCUMENTS

JP 2014206146 A 10/2014
KR 20130111744 A 10/2013
KR 20140107344 A 9/2014
KR 20150071830 A * 6/2015

OTHER PUBLICATIONS

International Search Report issued in PCT/KR2022/001729 on May 16, 2022.
Yoshida, et al.: "Reduction of the BPF Noise Radiated from an Engine Cooling Fan," SAE International, Technical Paper 2014-01-0631, (2014), pp. 1-7, doi:10.4271/2014-01-0631.

* cited by examiner

*Primary Examiner* — Sabbir Hasan
(74) *Attorney, Agent, or Firm* — NORTON ROSE FULBRIGHT US LLP

(57) ABSTRACT

The present invention relates to a fan shroud provided in a cooling module, and an object of the present invention is to provide a fan shroud assembly in which a baffle is selectively provided in some sections between a plurality of fixing members provided in a ventilation port of a fan shroud, thereby reducing deterioration in rigidity and durability of the fan shroud and effectively reducing BPF noise.

9 Claims, 8 Drawing Sheets

FAN SHROUD ASSEMBLY

CROSS REFERENCE TO RELATED APPLICATIONS

This patent application is a national phase under 35 U.S.C. § 371 of International Patent Application No. PCT/KR2022/001729 filed Feb. 4, 2022, which claims the benefit of priority from Korean Patent Application No. 10-2021-0016760 filed Feb. 5, 2021, each of which is hereby incorporated herein by reference in its entirety for all purposes.

TECHNICAL FIELD

The present invention relates to a fan shroud assembly, and more particularly, to a fan shroud assembly in which a fan, which forcibly blows air, is supported on an air-cooled heat exchanger and coupled to the heat exchanger, and a structure capable of reducing noise during a process of blowing air is provided.

BACKGROUND ART

In general, various air conditioning systems, cooling systems, and the like are installed in vehicles. The air conditioning system approximately includes cooling and heating modules for adjusting air a temperature, a humidity, and the like in an interior space in which a vehicle occupant is present. The cooling system includes modules for cooling an engine, a motor, and the like to prevent the engine, the motor, and the like from being overheated. These various modules are configured to implement desired cooling, heating, and refrigerating operations by transferring heat while circulating heat exchange media such as a refrigerant and a coolant.

The air conditioning system or the cooling system includes various heat exchangers. Among the heat exchangers, there is an air-cooled heat exchanger that cools a heat exchange medium therein by using outside air. As well known, heat exchange efficiency is improved as a velocity of air flowing to a core of the air-cooled heat exchanger. Therefore, generally, a fan shroud is coupled to a front surface of the air-cooled heat exchanger to forcibly blow air toward the core of the heat exchanger without allowing the heat exchange to be performed only by vehicle-induced wind. The fan shroud refers to a kind of device assembling component that stably supports a fan, which includes a hub and a plurality of blades, and a motor, which is configured to rotate the fan, and enables the fan and the motor to be coupled to another device.

FIG. 1 is a perspective view of a general fan shroud assembly. As illustrated, a fan shroud 100 includes a peripheral part 110 configured to surround an outer periphery of a fan 200, and a planar part 120 configured to face a heat exchanger. A ventilation port 150 is formed in a central portion of the peripheral part 110 and provides an empty space through which an airflow generated by the fan 200 passes to blow air. A motor provided on a shaft of the fan 200 is accommodated and supported in a hub part 151 provided at a center of the ventilation port 150. As illustrated, a plurality of fixing members 152 is disposed radially around the hub part 151 to stably fix and support a position of the hub part 151, and two opposite ends of the fixing member 152 are respectively connected to an inner peripheral edge of the peripheral part 110 and an outer peripheral edge of the hub part 151. In this case, a thickness of the peripheral part 110 may be generally larger than a thickness of the planar part 120 to increase a width of an inner peripheral edge of the peripheral part 110 connected to the fixing member 152, thereby ensuring appropriate rigidity by increasing a width of the fixing member 152. That is, as clearly illustrated in an enlarged view shown at a lower side of FIG. 1, the peripheral part 110 protrudes, and a lateral surface of the peripheral part 110 is visible, when viewed from a surface of the planar part 120. In the enlarged view in FIG. 1, a boundary between the peripheral part 110 and the planar part 120 is not clearly visible. Therefore, the peripheral part is shown in a light color, and the planar part 120 is shown in a dark color.

Meanwhile, significant noise inevitably occurs during a process in which the fan forcibly blows air. More specifically, generally, noise with a pulsation waveform having a frequency, which is the product of the number of blades and the rotational speed, occurs when a fluid, which is transported by fluid transport blades in a fluid machine, passes through a cut-off portion of the fluid machine. The noise is referred to as a blade pass frequency (BPF) noise. The blades of the fan 200 correspond to the fluid transport blades, and the ventilation port 150 corresponds to a cut-off portion. The BPF noise significantly occurs even in the fan shroud assembly when the fan 200 operates.

Various studies have been conducted to improve a shape or structure of the fan shroud to reduce the BPF noise. As an example, Korean Patent Laid-Open No. 2013-0111744 ("Fan Shroud for Reducing Noise", Oct. 11, 2013) discloses a fan shroud which is illustrated in FIG. 1 and has a plurality of long holes and a plurality of short holes disposed to be closer to an outer peripheral edge of the peripheral part 110 and formed through the planar part 120. As described above, various technologies have been conducted to reduce the BPF noise by forming the holes at appropriate positions on the fan shroud and controlling a part of the airflow passing through the ventilation port 150. However, because the hole formed in the fan shroud corresponds to a kind of flaw in consideration of the structure, there is a risk that the hole may degrade the rigidity and durability of the fan shroud.

In another example disclosed in "Reduction of the BPF Noise Radiated from an Engine Cooling Fan" (Yoshida K. et al., SAE 2014 World Congress & Exhibition, Apr. 1, 2014), an attempt has been made to reduce the BPF noise by changing a shape of the fan shroud. FIG. 2 is an embodiment in which the shape of the fan shroud is changed to reduce the BPF noise according to the studies in the related art. As illustrated in the upper views in FIGS. 1 and 2, the general fan shroud is shaped such that the planar part 120 is formed in an approximately rectangular shape corresponding to a shape of the core of the heat exchanger, and the peripheral part 110 is formed on a central portion of the planar part 120. It has been known that when a portion where a gap between the blade of the fan 200 and the fan shroud is small is referred to as a narrow portion, a significant large amount of BPF noise occurs in the narrow portion. As illustrated in the lower view in FIG. 2, the study illustrated in FIG. 2 forms an additional airflow space in the narrow portion in the direction in which the fan 200 rotates, thereby consequently providing a shape change for reducing the BPF noise by expanding the narrow portion. However, there is concern that the shape change forms an asymmetric shape of the fan shroud and causes undesired vibration, which degrades the rigidity and durability of the fan shroud and the assembly of the fan shroud. Further, there is also concern that the unnecessary vibration causes new vibration noise. Furthermore, because the additional airflow space protrudes from a shape of the existing fan shroud, the additional airflow space inevitably interferes with peripheral components at the time of assembling a cooling module and applying a vehicle package.

DOCUMENTS OF RELATED ART

Patent Document

1. Korean Patent Laid-Open No. 2013-0111744 ("Fan Shroud for Reducing Noise", Oct. 11, 2013)

Non-Patent Document

1. "Reduction of the BPF Noise Radiated from an Engine Cooling Fan"(Yoshida K. et al., SAE 2014 World Congress & Exhibition, Apr. 1, 2014)

DISCLOSURE

Technical Problem

Therefore, the present invention has been made in an effort to solve the above-mentioned problem in the related art, and an object of the present invention is to provide a fan shroud assembly in which a baffle is selectively provided in some sections between a plurality of fixing members provided in a ventilation port of a fan shroud, thereby reducing deterioration in rigidity and durability of the fan shroud and effectively reducing BPF noise.

Technical Solution

To achieve the above-mentioned object, the present invention provides a fan shroud assembly including: a fan 200 including a hub coupled to a rotary shaft of a motor, and a plurality of blades provided on an outer peripheral surface of the hub; and a fan shroud including a peripheral part 110 configured to surround an outer periphery of the fan 200, a planar part 120 configured to face a heat exchanger, a ventilation port 150 formed in a central portion of the peripheral part 110 and configured to allow an airflow, which is generated by the fan 200, to pass through the ventilation port to blow air, a hub part 151 provided at a center of the ventilation port 150 and configured to accommodate and support the motor provided on a shaft of the fan 200, and a plurality of fixing members 152 connected to an inner peripheral edge of the peripheral part 110 and an outer peripheral edge of the hub part 151 and disposed radially around the hub part 151, in which when spaces between the plurality of fixing members 152 are referred to as unit ventilation spaces 155, a noise reduction means is provided in at least one selected from the plurality of unit ventilation spaces 155 to control a part of the airflow passing through the ventilation port. In this case, the noise reduction means may be a baffle 10 that blocks a part of an outer peripheral edge side of the unit ventilation space 155.

In addition, the baffle 10 may be formed such that one end thereof is disposed in the unit ventilation space 155 and connected to the inner peripheral edge of the peripheral part 110, and two opposite ends thereof are connected to the pair of fixing members 152 that defines two opposite boundaries of the unit ventilation space 155. In addition, the other end of the baffle 10 may be formed in a straight shape parallel to a normal direction at an outermost side point of one end.

In addition, the baffles 10 may be provided in the pair of unit ventilation spaces 155 disposed to face each other.

In this case, the fan shroud 100 may be formed such that an extension line, which is defined by the pair of unit ventilation spaces 155 disposed to face each other and having the baffles 10 respectively provided therein, is inclined with respect to a vertical direction and a horizontal direction.

In addition, the fan shroud 100 may be formed such that an angle of the extension line with respect to the vertical direction is smaller than an angle of the extension line with respect to the horizontal direction.

In addition, the fan shroud 100 may be formed such that the baffle 10 is provided in the unit ventilation space 155 disposed adjacent to upper and lower narrow portions where a circular shape of the peripheral part 110 and a rectangular shape of the planar part 120 overlap each other.

In addition, the fan shroud 100 may be formed such that the extension line is inclined in a direction opposite to a rotation direction of the fan 200.

In addition, when a maximum distance between the two opposite ends is referred to as a baffle length 1 and a maximum distance between one end and the other end is referred to as a baffle width w, the baffle 10 may be formed such that a value of a ratio of the baffle width w to the baffle length 1 is within a range of 10 to 20%.

More particularly, the baffle 10 may be formed such that the value of the ratio of the baffle width w to the baffle length 1 may be within a range of 10.9 to 16.4%.

In addition, the baffles 10 may be provided in the pair of unit ventilation spaces 155 disposed to face each other, and the baffle width w of the baffle 10 provided at an upper side is larger than the baffle width w of the baffle 10 provided at a lower side.

More specifically, the baffles 10 may be provided in the pair of unit ventilation spaces 155 disposed to face each other, the baffle width w of the baffle 10 provided at an upper side may be set to a maximum value within the range of the ratio of the baffle width w to the baffle length 1, and the baffle width w of the baffle 10 provided at a lower side may be set to a minimum value within the range of the ratio of the baffle width w to the baffle length 1.

Advantageous Effects

According to the present invention, the baffle is selectively provided in some of the sections between the plurality of fixing members provided in the ventilation port of the fan shroud, thereby effectively reducing the BPF noise. More specifically, in the present invention, the baffle, which serves as a barrier that blocks a part of the airflow blown to the outer peripheral edge side of the ventilation port, is provided in some selected from the sections between the plurality of fixing members provided in the ventilation port of the fan shroud in order to appropriately control the airflow, thereby effectively reducing the BPF noise by reducing interference between air and the peripheral part that is a peripheral structure of the ventilation port.

In the related art, a configuration in which a hole for additionally discharging air is formed in a fan shroud to control an airflow, is widely used to reduce BPF noise. However, because the hole formed in the fan shroud acts as a kind of flaw in consideration of a structure, there is a problem in that the hole degrades rigidity and durability of the fan shroud. However, according to the present invention, the component, such as the hole, which acts as a flaw, is not provided, and the baffle is further provided between the fixing members, thereby improving the structural rigidity. That is, collectively, the present invention may reduce noise and completely eliminate a risk of deterioration in rigidity and durability of the fan shroud.

Furthermore, in case that in the related art, an additional airflow space is formed in a narrow portion to reduce the BPF noise, and the additional airflow space protrudes, which causes a problem of unnecessary interference with the peripheral object at the time of packaging the cooling module. In contrast, the present invention does not cause the problem.

DESCRIPTION OF REFERENCE NUMERALS

Figure 1:
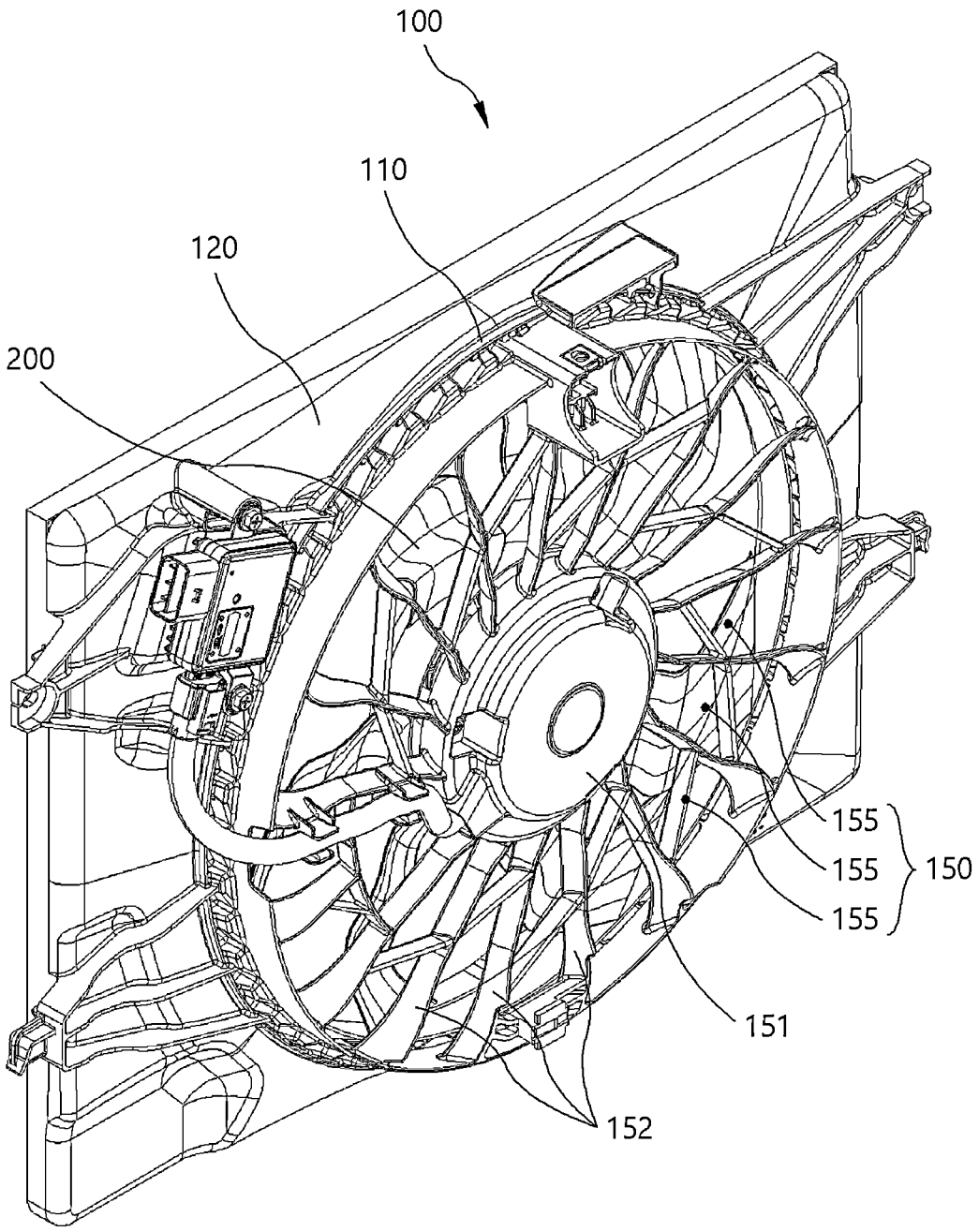
FIG. 1 is a perspective view of a fan shroud assembly in the related art.

100: Fan shroud
110: Peripheral part
120: Planar part
150: Ventilation port
151: Hub part
152: Fixing member
155: Unit ventilation space
10: Baffle

MODE FOR INVENTION

Hereinafter, a fan shroud assembly according to the present invention configured as described above will be described in detail with reference to the accompanying drawings.

Figure 3:
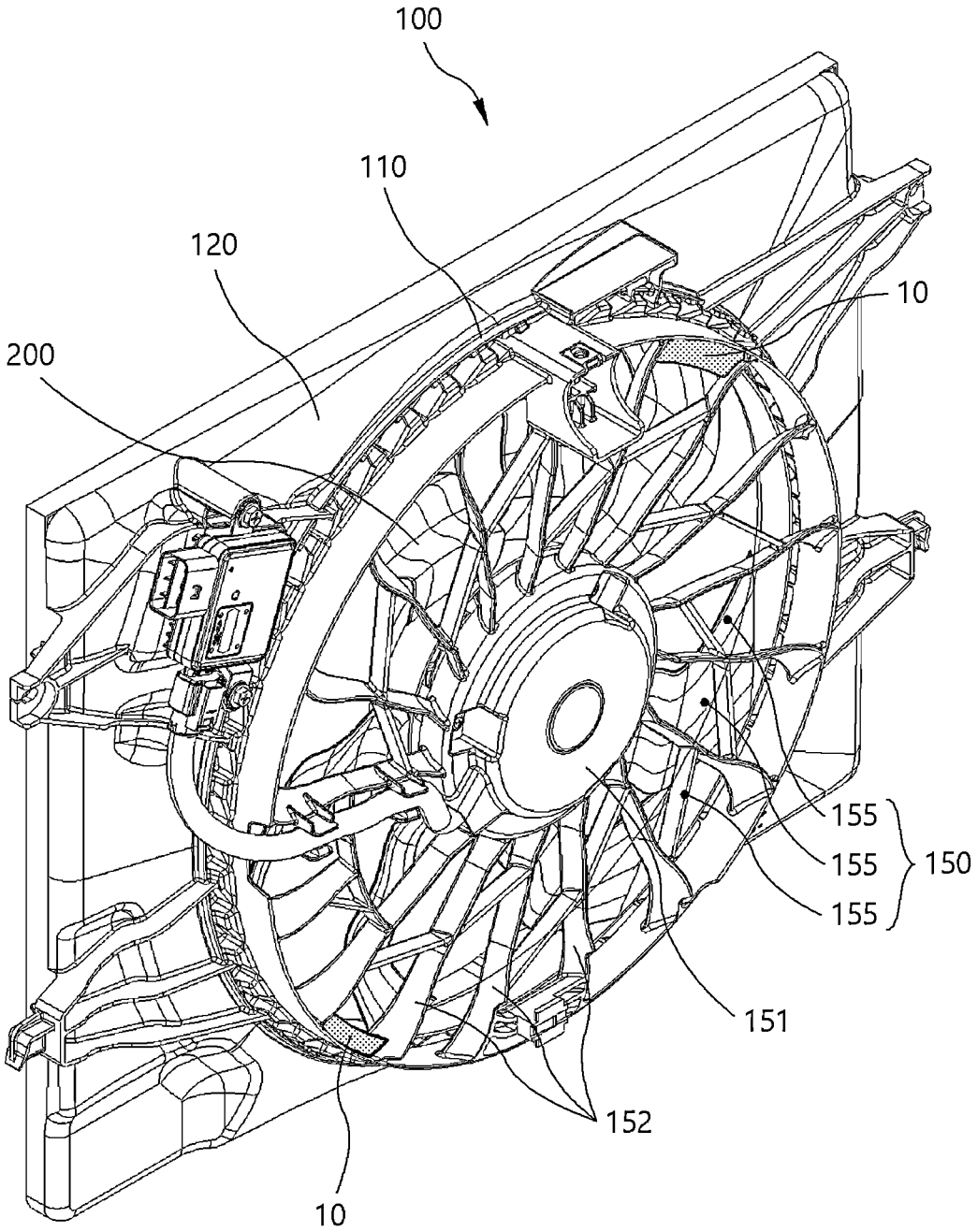
FIG. 3 is a perspective view of a fan shroud assembly of the present invention.
Figure 4:
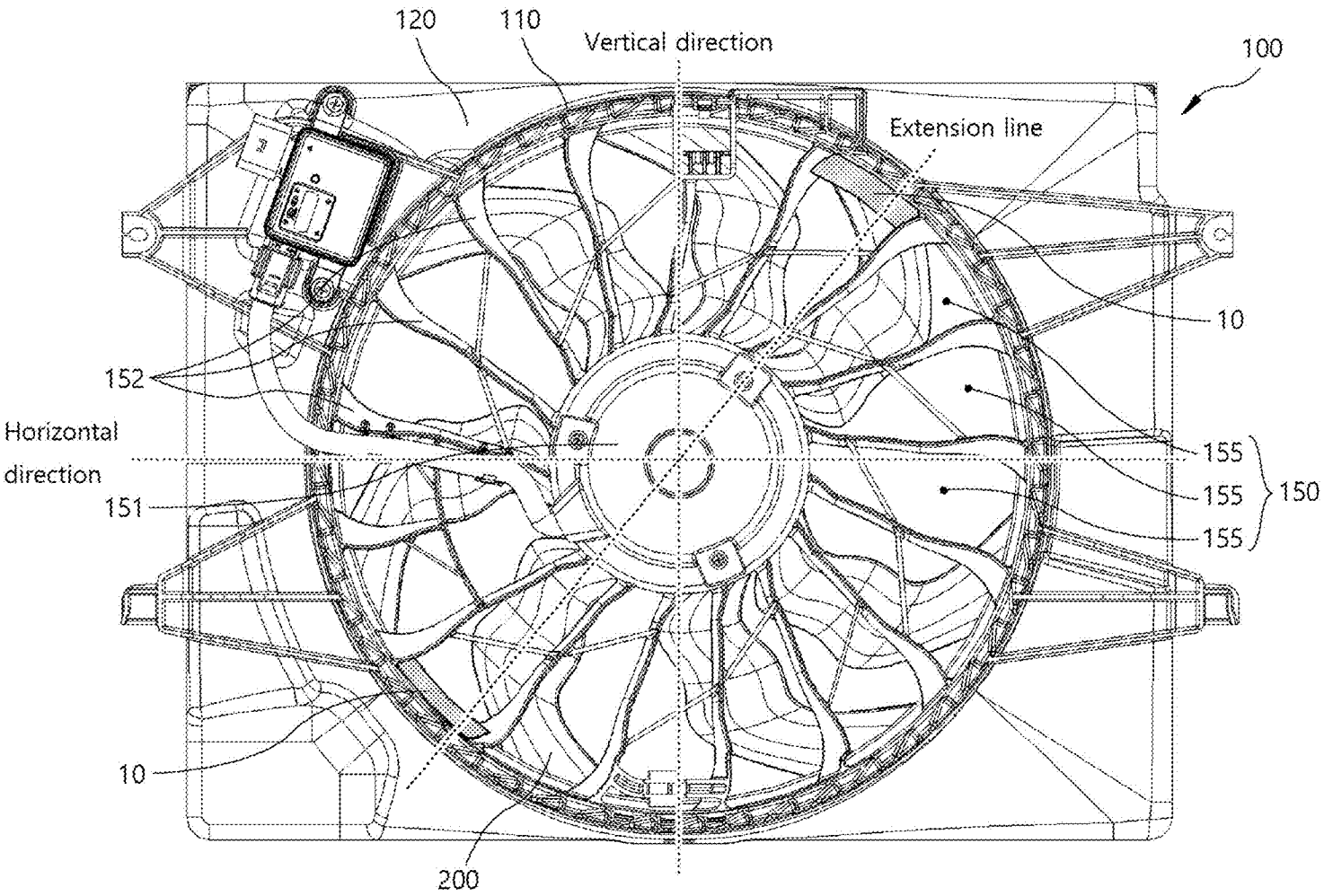
FIG. 4 is a front view of the fan shroud assembly of the present invention.

FIG. 3 is a perspective view of a fan shroud assembly of the present invention, and FIG. 4 is a front view of the fan shroud assembly of the present invention. As illustrated in FIGS. 3 and 4, the fan shroud assembly of the present invention basically includes a fan 200 and a fan shroud 100. Basic shapes of the fan and the fan shroud will be briefly described. The fan 200 includes a hub coupled to a rotary shaft of a motor, and a plurality of blades provided on an outer peripheral surface of the hub. In addition, the fan shroud 100 includes a peripheral part 110 configured to surround an outer periphery of the fan 200, a planar part 120 configured to face a heat exchanger, a ventilation port 150 provided in the form of an empty space formed in a central portion of the peripheral part 110 and configured to allow an airflow, which is generated by the fan 200, to pass through the ventilation port 150 to blow air, a hub part 151 formed at a center of the ventilation port 150 and configured to accommodate and support the motor provided on a shaft of the fan 200, and a plurality of fixing members 152 connected to an inner peripheral edge of the peripheral part 110 and an outer peripheral edge of the hub part 151 and disposed radially around the hub part 151.

In this case, when spaces between the plurality of fixing members 152 are referred to as unit ventilation spaces 155, the fan shroud 100 of the present invention has a noise reduction means provided in at least one selected from the plurality of unit ventilation spaces 155. More specifically, in the present invention, the noise reduction means is a baffle 10 that blocks a part of an outer peripheral edge side of the unit ventilation space 155. The baffle 10 controls a part of an airflow passing through the ventilation port 150, thereby reducing BPF noise caused by the airflow. That is, when a part of the airflow is deformed by the baffle 10 as described above, a shape of a flow, which causes BPF noise, may be changed from an original airflow, which makes it possible to reduce the BPF noise.

Figure 2:
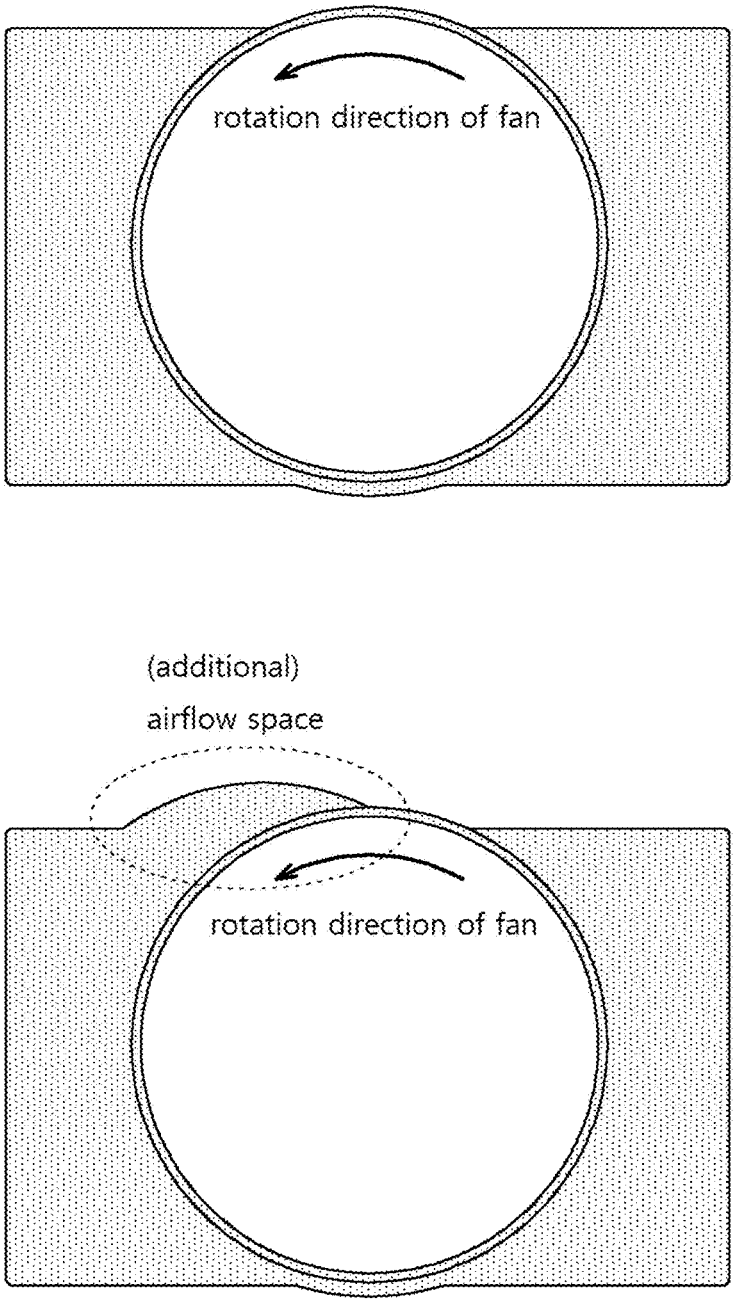
FIG. 2 is a view illustrating an embodiment in which a shape of a fan shroud is changed to reduce BPF noise in the related art.

In the related art, a configuration in which a hole for additionally discharging air is formed in a fan shroud to control an airflow, is widely used to reduce BPF noise. However, because the hole formed in the fan shroud acts as a kind of flaw in consideration of a structure, there is a problem in that the hole degrades rigidity and durability of the fan shroud. In contrast, in the present invention, the configuration in which the noise reduction means is further provided in the unit ventilation space 155 is provided, such that the component corresponding to the flaw may be basically excluded, and the structural rigidity may be improved. Further, in the related art illustrated in FIG. 2, an additional airflow space causes an overall asymmetric shape, which causes a problem of interference with peripheral components. In contrast, in the present invention, the noise reduction means is additionally provided between the structures that are originally present, such that no protruding structure is provided, and the above-mentioned problem is also basically eliminated. That is, collectively, the present invention may reduce noise and completely eliminate a risk of deterioration in rigidity and durability of the fan shroud.

In the present invention, as described above, the noise reduction means may be provided in the form of the baffle 10 that blocks a part of the outer peripheral edge side of the unit ventilation space 155. That is, more specifically, the baffle 10 is provided in the form of a plate provided between the fixing members 152.

Hereinafter, a specific shape of the baffle 10 will be described in more detail.

As described above, the baffle 10 is provided in the selected unit ventilation space 155 to block a part of the unit ventilation space 155. More specifically, as clearly illustrated in FIG. 4, the baffle 10 is formed such that one end thereof is disposed in the unit ventilation space 155 and connected to an inner peripheral edge of the peripheral part 110, and two opposite ends thereof are connected to the pair of fixing members 152 that defines two opposite boundaries of the unit ventilation space 155.

One end of the baffle 10 is formed as a curved line corresponding to the inner peripheral edge of the peripheral part 110, i.e., formed as a part of a circumference. As described above, the baffle 10 is formed to block a part of the outer peripheral edge side of the unit ventilation space 155. All the unit ventilation spaces 155 are collected and define the ventilation port 150. An outer peripheral edge of the ventilation port 150 substantially coincides with the inner peripheral edge of the peripheral part 110. In this case, the ventilation port 150 is a portion provided in the form of an empty space, and the peripheral part 110 is an actual component. Therefore, in consideration of the above-mentioned configuration, one end of the baffle 10 is described as being connected to "the inner peripheral edge of the peripheral part 110".

The other end of the baffle 10 may be formed as a part of the circumference so as to correspond to one end of the baffle 10. However, to improve manufacturability and maximize an area that blocks the airflow, the baffle may be formed in a straight shape parallel to a normal direction at an outermost side point of one end.

Meanwhile, in the embodiment in FIG. 4, the fixing member 152 of the fan shroud 100 has a curved shape, such that the two opposite ends of the baffle 10 are partially covered by the curved shape when viewed from the front side. This configuration will be described below in more detail with reference to enlarged views.

Hereinafter, an optimal arrangement of the baffle 10 will be described in more detail.

Because the baffle 10 is formed in the above-mentioned shape, the baffle 10 may control the airflow by blocking a part of the outer peripheral edge side of the unit ventilation space 155. In this case, the BPF noise reduction effect naturally varies depending on the location at which the baffle 10 is provided. Therefore, the baffle 10 needs to be properly disposed at an appropriate position.

As can be intuitively seen from the front view in FIG. 4, the peripheral part 110 of the fan shroud 100 defines an approximately circular shape, and the planar part 120 defines an approximately rectangular shape. That is, the fan shroud 100 has a shape made by a combination of a circular shape defined by the peripheral part 110 and a rectangular shape defined by the planar part 120. The ventilation port 150 is formed in the central portion of the peripheral part 110, and the planar part 120 faces the heat exchanger. A relatively large amount of air is accumulated and collected on a portion where the circular shape defined by the peripheral part 110 and the rectangular shape defined by the planar part 120 overlap each other or are disposed adjacent to each other, such that a large amount of air flows in the relatively narrow region, which causes the BPF noise.

As described above, the baffle 10 reduces the BPF noise by changing a part of the airflow by blocking a part of the unit ventilation space 155. Therefore, the baffle 10 may be disposed at this position. Meanwhile, in case that the baffle 10 is provided at a position at which the BPF noise reduction effect is not high, only an adverse effect of unnecessarily reducing the airflow toward the ventilation port 150 occurs. Therefore, it is not necessary to install an excessively large number of baffles 10.

In consideration of these factors, as illustrated in FIG. 4, the pair of baffles 10 may be provided in the pair of unit ventilation spaces 155 disposed to face each other. In this case, as clearly illustrated in FIG. 4, an extension line, which is defined by the pair of unit ventilation spaces 155 disposed to face each other and having the baffles 10 respectively provided therein, may be inclined with respect to a vertical direction and a horizontal direction. More particularly, an angle of the extension line with respect to the vertical direction may be smaller than an angle of the extension line with respect to the horizontal direction.

The optimal arrangement of the baffle 10 will be intuitively described below. As described above, the fan shroud 100 is generally formed in a shape made by combining the circular shape of the peripheral part 110 and the rectangular shape of the planar part 120. The largest amount of air is collected in upper and lower narrow portions where the circular shape of the peripheral part 110 and the rectangular shape of the planar part 120 overlap each other. It is known that the largest amount of BPF noise occurs in these portions. Therefore, in the present invention, the fan shroud 100 may be most preferably configured such that the baffle 10 is provided in the unit ventilation space 155 disposed adjacent to the upper and lower narrow portions.

However, in this case, to properly obtain the BPF noise reduction effect, the airflow needs to be changed in advance before the air passes through the upper or lower narrow portion. Therefore, the fan shroud 100 may be formed such that the extension line is inclined in a direction opposite to a rotation direction of the fan 200.

Hereinafter, an optimal shape of the baffle 10 will be described in more detail.

Figure 5:
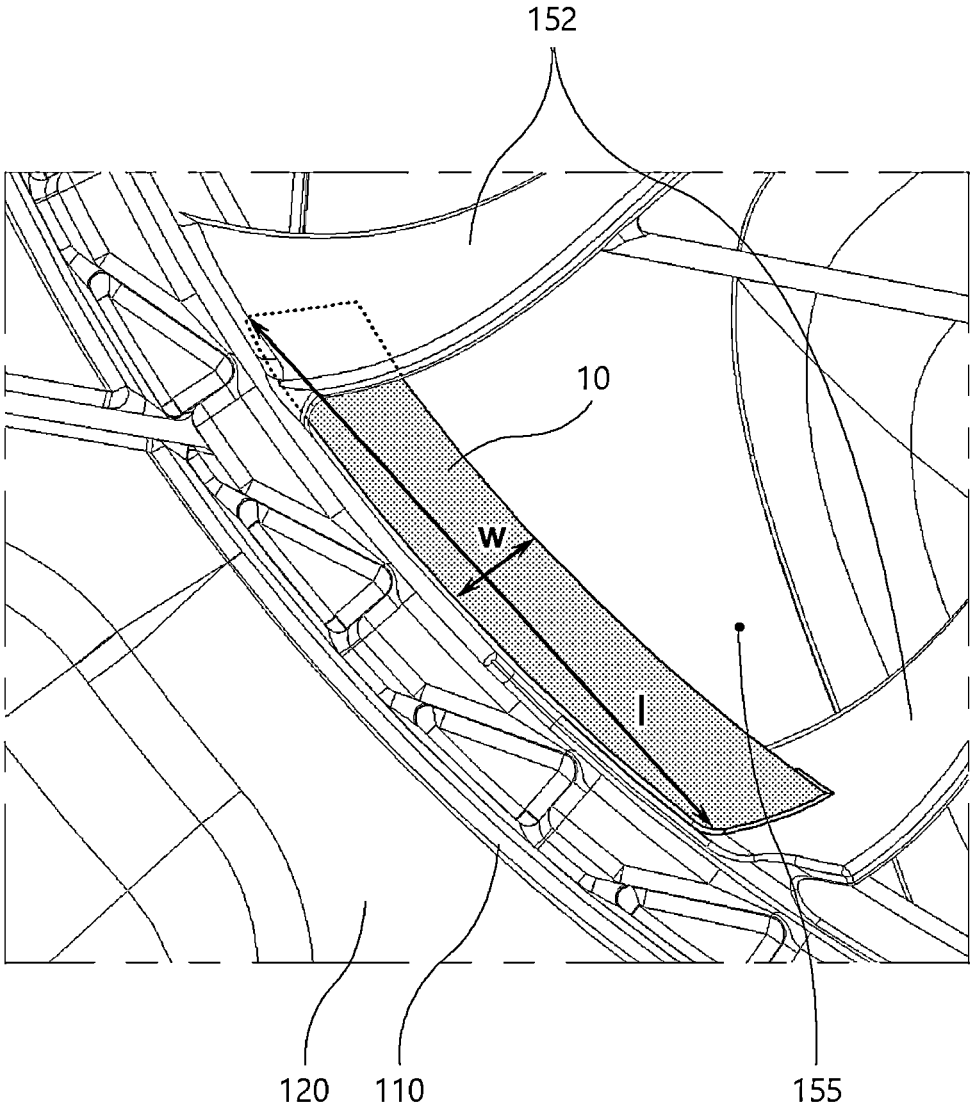
FIG. 5 is an enlarged view of a lower baffle.
Figure 6:
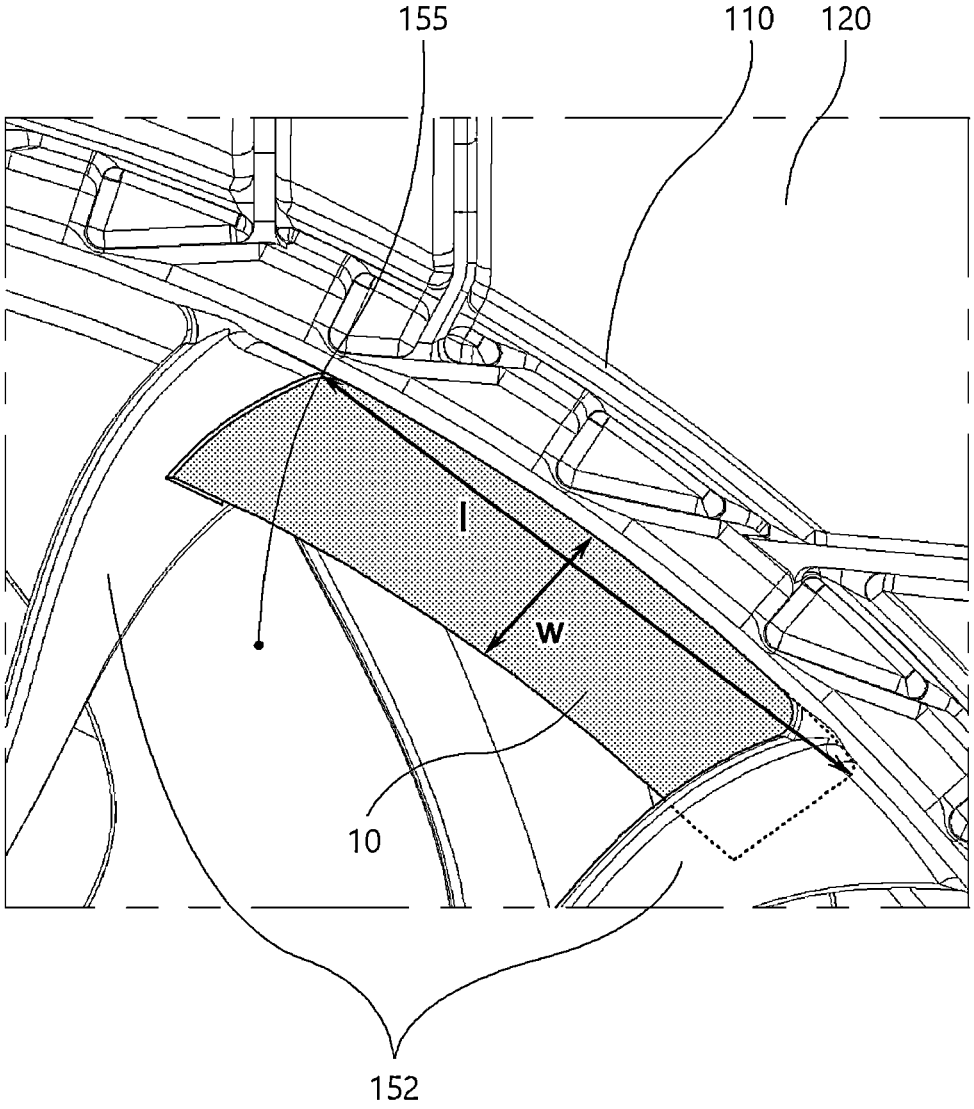
FIG. 6 is an enlarged view of an upper baffle.

According to the description of the shape of the baffle 10, one end and the two opposite ends, i.e., the three ends of the baffle 10 are respectively connected to the inner peripheral edge of the peripheral part 110 and the pair of fixing members 152. In this case, the peripheral part 110 is also formed in a circularly curved shape, the fixing member 152 is also formed in a curved shape, and the plurality of fixing members 152 is radially disposed. Therefore, a distance between the two opposite ends of the baffle 10 and a distance between one end and the other end of the baffle 10 are not determined as a single value. To determine a reference shape in consideration of these factors, a maximum distance between the two opposite ends of the baffle 10 is referred to as a baffle length 1, and a maximum distance between one end and the other end of the baffle 10 is referred to as a baffle width w. FIGS. 5 and 6 are respectively enlarged views of lower and upper baffles. Portions of the baffle 10, which are covered by the fixing member 152 having a curved shape, are indicated by the dotted lines, and the baffle width w and the baffle length 1 are clearly illustrated in the drawings.

Figure 7:
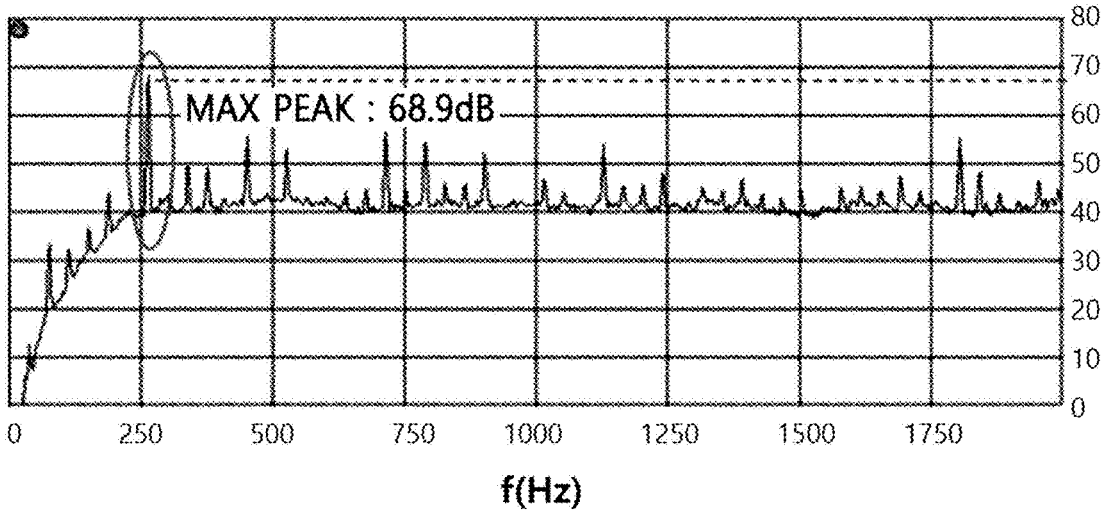
FIG. 7 is a graph showing comparison between noise reduction effects obtained by the baffle of the present invention.
Figure 7:
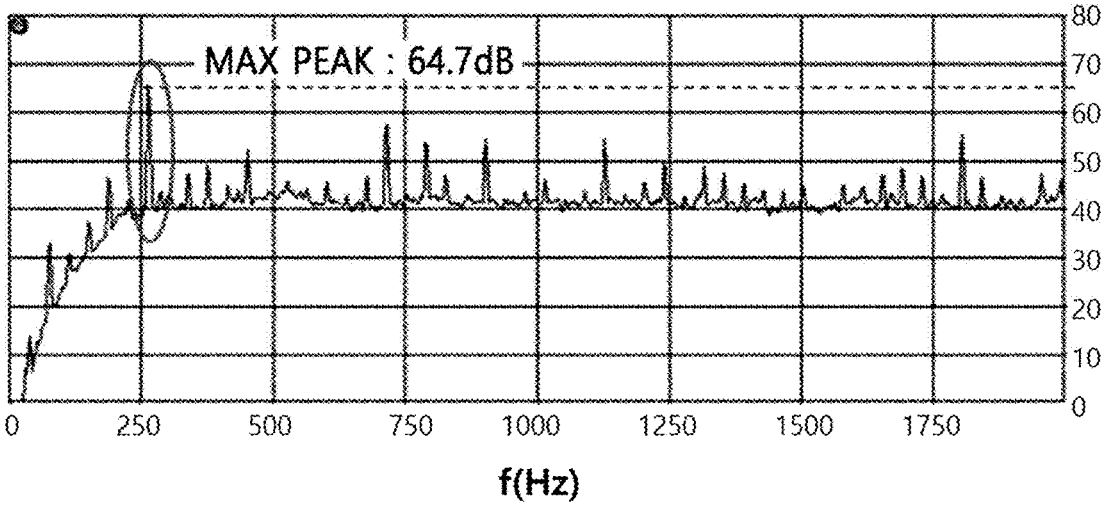

FIG. 7 is a graph showing comparison between noise reduction effects obtained by the baffle of the present invention. In FIG. 7, the upper graph is a graph showing a result of measuring the amount of noise L (dB) with respect to a frequency f (Hz) in a fan shroud in the related art having no baffle, and the lower graph is a graph showing a result of measuring the amount of noise L (dB) with respect to a frequency f (Hz) in the fan shroud of the present invention having the baffle and shows one experimental result of finding an optimal embodiment. In the related art, a first peak value is 68.9 dB. In contrast, in the present invention, a first peak value is 64.7 dB, and thus it can be ascertained from FIG. 7 that there is an effect of reducing the BPF noise by 4.2 dB. Meanwhile, O/A noise in the noise analysis means noise made by summing up the peak values such as peak values in the above-mentioned graph. As can be intuitively seen from the graphs in FIG. 7, it is well known that the first peak significantly affects the O/A noise. According to the analysis of the results shown in the upper and lower graphs, it can be ascertained that the present invention provides the effect of reducing the overall noise, i.e., the O/A noise by 0.4 dB by effectively reducing the BPF noise (i.e., the first peak value) in comparison with the related art.

Figure 8:
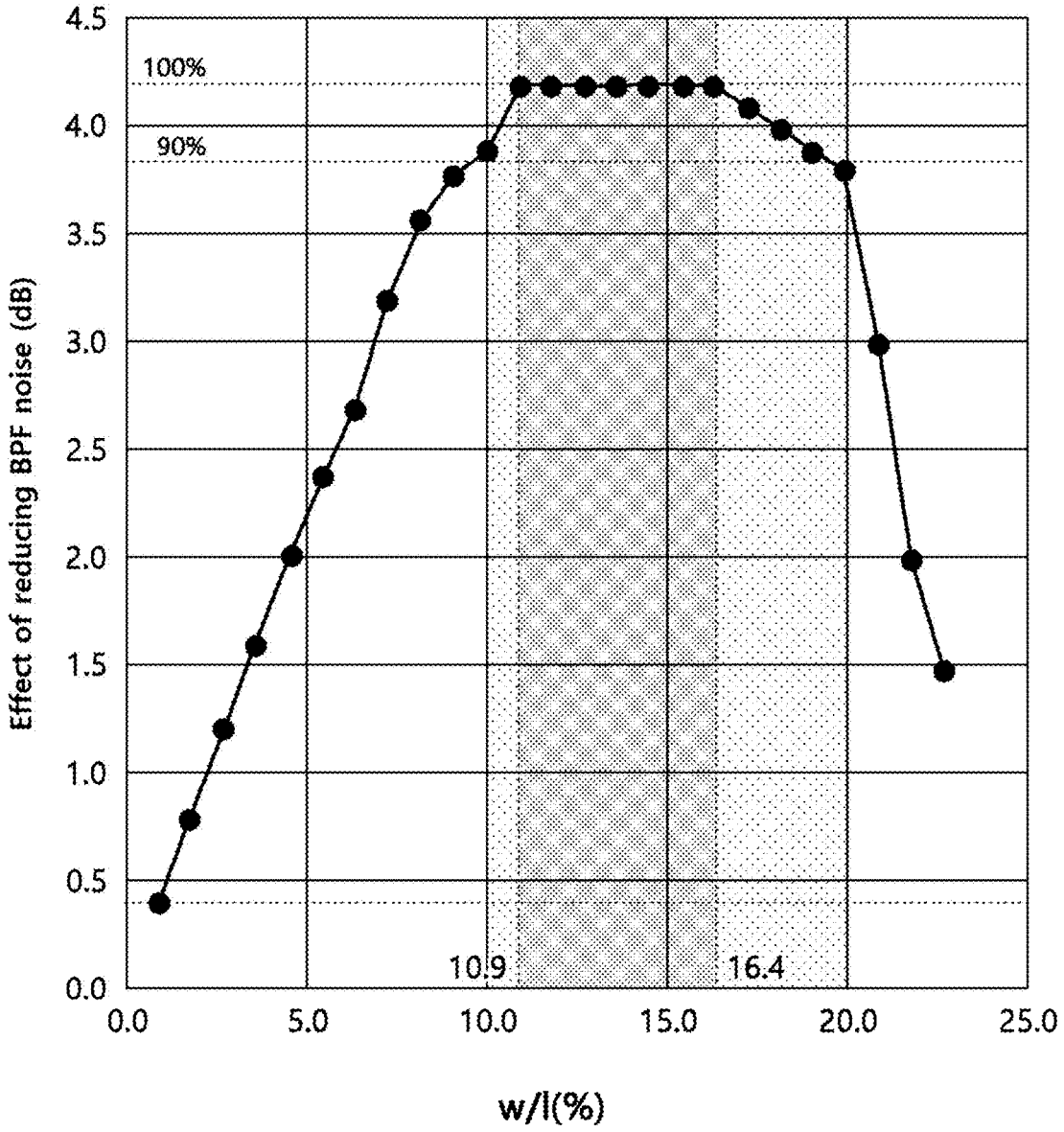
FIG. 8 is a graph showing a result of an experiment for deriving an optimal shape of the baffle of the present invention.

FIG. 8 is a graph showing a result of an experiment for deriving an optimal shape of the baffle of the present invention. The experiment in FIG. 8 was performed by measuring the amount of reduction in BPF noise while changing the baffle width w and the baffle length 1 when the baffle 10 is in an optimal arrangement state, as illustrated in FIG. 4. In this case, the experiment may be considered as being performed by substantially changing the baffle width w because the baffle length 1 is a fixed value (an interval between the fixing members 152 is fixed). That is, the experimental results shown in the lower graph in FIG. 7 are obtained by changing the baffle width w, and the graph in FIG. 8 shows the first peak values of the experimental results.

As clearly shown in the graph in FIG. 8, it can be ascertained that as a value of a ratio of the baffle width w to the baffle length 1 increases, the noise reduction effect gradually increases, the noise reduction effect is maintained constantly in any section, and then the noise reduction effect decreases after the section. That is, physically, the analysis may be determined as follows. The effect of reducing the BPF noise is gradually increased by changing the airflow as the baffle width w increases. When any section is reached, the noise reduction effect is maintained without greatly fluctuating. When the baffle width w increases over the section, the noise reduction effect is rather decreased by an adverse effect that excessively blocks the airflow.

With reference to the graph in FIG. 8, when a range of fluctuation of the overall BPF noise reduction effect is 100%, a range in which the noise reduction effect is about 90% is a range in which the value of the ratio of the baffle width w to the baffle length 1 is 10 to 20%. Therefore, the value of the ratio of the baffle width w to the baffle length 1 within this range is proper. Meanwhile, as clearly illustrated in FIG. 8, the present invention provides a significantly apparent critical section. Accurately, the critical section is within a range of 10.9 to 16.4%. That is, it is possible to maximize the BPF noise reduction effect as the value of the ratio of the baffle width w to the baffle length 1 is set within the range of 10.9 to 16.4%.

Meanwhile, as can be seen from FIG. 8, in case that the value of the ratio of the baffle width w to the baffle length 1 is within the critical section, the effect of reducing the BPF noise is almost equally maintained even though the baffle width w is changed. In this case, the noise reduction effect may, of course, increase as the baffle width w increases. However, there is a problem in that the amount of air blown through the ventilation port 150 slightly decreases. In consideration of these factors, the baffle width w may be minimized to prevent a loss of an air flow rate. Meanwhile, the fixing members 152, to which the two opposite ends of the baffle 10 are connected, basically serve to fix the hub part 151. Therefore, it is apparent that the fixing member 152 disposed above the hub part 151 receives a force for pulling the fixing member 152 by a weight of the hub part 151. This influence may concentrate stress on a connection portion between the fixing member 152 and the peripheral part 110. In this case, when the baffle 10 disposed at the upper side is provided between the fixing members 152, the concentration of stress may be mitigated to some extent, which assists in improving the overall rigidity of the fan shroud 100. That is, in consideration of these factors, the baffle width w may be maximized to improve the rigidity in case that the baffle 10 is provided at the upper side.

As in the optimal arrangement in FIG. 4, when the baffles 10 are provided in the pair of unit ventilation spaces 155 disposed to face each other, the baffle width w of the baffle 10 installed at the upper side may be larger than the baffle width w of the baffle 10 installed at the lower side in consideration of the above-mentioned two factors, i.e., the prevention of a loss of air flow rate and the improvement of rigidity. More particularly, the baffle width w of the baffle 10 provided at the upper side may be set to a maximum value within the range of the ratio of the baffle width w to the baffle length 1 to maximize the effect of improving the rigidity. The baffle width w of the baffle 10 provided at the lower side may be set to a minimum value within the range of the ratio of the baffle width w to the baffle length 1 to maximize the effect of preventing a loss of air flow rate.

The present invention is not limited to the above embodiments, and the scope of application is diverse. Of course, various modifications and implementations made by any person skilled in the art to which the present invention pertains without departing from the subject matter of the present invention claimed in the claims.

INDUSTRIAL APPLICABILITY

According to the present invention, the hole having the optimized shape is formed at the appropriate position on the fan shroud, such that a great effect of effectively reducing the BPF noise may be obtained. The compatibility of the hole is high because the hole is applied without changing the entire structure of the fan shroud in the related art, which is advantageous in manufacturing and producing the fan shroud.

What is claimed is:

1. A fan shroud assembly comprising:

a fan comprising a hub configured to be coupled to a rotary shaft of a motor, and a plurality of blades provided on an outer peripheral surface of the hub; and a fan shroud comprising a peripheral part configured to surround an outer periphery of the fan, a planar part configured to face a heat exchanger, a ventilation port formed in a central portion of the peripheral part and configured to allow an airflow, which is generated by the fan, to pass through the ventilation port to blow air, a hub part provided at a center of the ventilation port and configured to accommodate and support the motor provided on a shaft of the fan, and a plurality of fixing members connected to an inner peripheral edge of the peripheral part and an outer peripheral edge of the hub part and disposed radially around the hub part, wherein when a plurality of spaces between the plurality of fixing members are a plurality of unit ventilation spaces, a noise reduction means is provided in at least one selected from the plurality of unit ventilation spaces to control a part of the airflow passing through the ventilation port, wherein the noise reduction means is a baffle that blocks a part of an outer peripheral edge side of the plurality of unit ventilation spaces, wherein the baffle is formed such that one end thereof is disposed in the plurality of unit ventilation spaces and connected to the inner peripheral edge of the peripheral part, and two opposite ends thereof are connected to the pair of fixing members that defines two opposite boundaries of each of the plurality of the unit ventilation spaces.

2. The fan shroud assembly of claim 1, wherein the other end of the baffle is formed in a straight shape parallel to a normal direction at an outermost side point of one end.

3. The fan shroud assembly of claim 1, wherein when a maximum distance between the two opposite ends is referred to as a baffle length and a maximum distance between one end and the other end is referred to as a baffle width, the baffle is formed such that a value of a ratio of the baffle width to the baffle length is within a range of 10 to 20%.

4. The fan shroud assembly of claim 3, wherein the baffle is formed such that the value of the ratio of the baffle width to the baffle length is within a range of 10.9 to 16.4%.

5. The fan shroud assembly of claim 3, wherein the plurality of baffles are provided in the pair of unit ventilation spaces disposed to face each other, and the baffle width of the baffle provided at an upper side is larger than the baffle width of the baffle provided at a lower side.

6. The fan shroud assembly of claim 3, wherein the plurality of baffles are provided in the pair of unit ventilation spaces disposed to face each other, the baffle width of the baffle provided at an upper side is set to a maximum value within the range of the ratio of the baffle width to the baffle length, and the baffle width of the baffle provided at a lower side is set to a minimum value within the range of the ratio of the baffle width to the baffle length.

7. A fan shroud assembly comprising:

a fan comprising a hub configured to be coupled to a rotary shaft of a motor, and a plurality of blades provided on an outer peripheral surface of the hub; and a fan shroud comprising a peripheral part configured to surround an outer periphery of the fan, a planar part configured to face a heat exchanger, a ventilation port formed in a central portion of the peripheral part and configured to allow an airflow, which is generated by the fan, to pass through the ventilation port to blow air, a hub part provided at a center of the ventilation port and configured to accommodate and support the motor provided on a shaft of the fan, and a plurality of fixing members connected to an inner peripheral edge of the peripheral part and an outer peripheral edge of the hub part and disposed radially around the hub part, wherein when spaces between the plurality of fixing members are a plurality of unit ventilation spaces, a noise reduction means is provided in at least one unit ventilation space of the plurality of unit ventilation spaces to control a part of the airflow passing through the ventilation port, wherein the noise reduction means is a baffle of a plurality of baffles that block a part of an outer peripheral edge side of the unit ventilation space, wherein one baffle of the plurality of baffles are provided in each of a pair of unit ventilation spaces of the plurality of unit ventilation spaces disposed to face each other, wherein the fan shroud is formed such that an extension line, which is defined by a pair of unit plurality of ventilation spaces disposed to face each other and having the baffles respectively provided therein, is inclined with respect to a vertical direction and a horizontal direction, wherein the fan shroud is formed such that the baffle is provided in the unit ventilation space disposed adjacent to upper and lower narrow portions where a circular shape of the peripheral part and a rectangular shape of the planar part overlap each other.

8. The fan shroud assembly of claim 7, wherein the fan shroud is formed such that an angle of the extension line with respect to the vertical direction is smaller than an angle of the extension line with respect to the horizontal direction.

9. The fan shroud assembly of claim 7, wherein the fan shroud is formed such that the extension line is inclined in a direction opposite to a rotation direction of the fan.

* * * * *